US008736527B2

(12) United States Patent
Verlinden

(10) Patent No.: US 8,736,527 B2
(45) Date of Patent: May 27, 2014

(54) FLEXIBLE LED PIXEL STRING WITH TWO SHIELDING GROUND LINES

(71) Applicant: Martin Professional A/S, Aarhus N. (DK)

(72) Inventor: Wouter Verlinden, Zeeptsstraat (BE)

(73) Assignee: Martin Professional A/S, Aarhus N. (DK)

( * ) Notice: Subject to any disclaimer, the term of this patent is extended or adjusted under 35 U.S.C. 154(b) by 0 days.

(21) Appl. No.: 13/848,136

(22) Filed: Mar. 21, 2013

(65) Prior Publication Data

US 2013/0249417 A1 Sep. 26, 2013

(30) Foreign Application Priority Data

Mar. 21, 2012 (DK) ..... PA 2012 70130

(51) Int. Cl.
*G09G 3/32* (2006.01)

(52) U.S. Cl.
USPC ..... 345/82; 362/249.08; 439/49; 174/68.1

(58) Field of Classification Search
USPC ..... 345/46, 82, 83; 362/227, 231, 362/249.01–249.04, 249.08; 439/43, 49; 174/68.1
See application file for complete search history.

(56) References Cited

U.S. PATENT DOCUMENTS

| | | | | |
|---|---|---|---|---|
| 7,777,699 | B2 * | 8/2010 | Varrin et al. | 345/76 |
| 8,344,410 | B2 * | 1/2013 | Wendler et al. | 257/99 |
| 2006/0022214 | A1 | 2/2006 | Morgan et al. | |
| 2006/0039142 | A1 * | 2/2006 | Temple | 362/231 |
| 2007/0139315 | A1 * | 6/2007 | Abe | 345/76 |
| 2008/0180269 | A1 | 7/2008 | Furry et al. | |
| 2009/0121988 | A1 * | 5/2009 | Amo et al. | 345/82 |
| 2010/0001933 | A1 * | 1/2010 | Coker et al. | 345/83 |
| 2010/0124067 | A1 | 5/2010 | Hente et al. | |
| 2010/0164409 | A1 | 7/2010 | Lo et al. | |
| 2013/0135855 | A1 * | 5/2013 | Wildner | 362/231 |

OTHER PUBLICATIONS

Danish Office Action•, Application No. PA201270130; Filing Date: Mar. 21, 2012; Office Action dated Nov. 1, 2012; 4 pages.
Danish Search Report; Application No. PA201270130; Filing Date: Mar. 21, 2012; 2 pages.
European Search Report; European Patent Application No. 1360015.7; Dated: Jun. 17, 2013; 7 pages.

* cited by examiner

*Primary Examiner* — Thuy Vinh Tran
(74) *Attorney, Agent, or Firm* — Blank Rome LLP

(57) ABSTRACT

The present invention relates to a flexible LED pixel string comprising a number of LED pixels interconnected by a flexible cable, where the flexible LED pixel string comprises a connector for connecting the flexible LED pixel string to a data and power feeder. The flexible cable comprises a first conductor being a power line, a second conductor being a data line, a third conductor being a clock line, a fourth conductor being a first ground line and a third conductor being a second ground line. The data line or the clock line are arranged between the first ground line and the second ground line.

11 Claims, 6 Drawing Sheets

FLEXIBLE LED PIXEL STRING WITH TWO SHIELDING GROUND LINES

FIELD OF THE INVENTION

The present invention relates to flexible LED pixel strings where a number of pixels each comprising a number of LEDs have been connected by a flexible cable and thus constitutes a flexible string comprising a number of LED pixels.

BACKGROUND OF THE INVENTION

Flexible LED pixel strings where a number of LED pixels are interconnected by a flexible cable are commonly known in the field of visual solutions. Typically each LED pixel comprises a number of red LEDs, a number of blue LEDs and a number of green LEDs which can be dimmed in relation to each other whereby a large number of colors can be created by each LED pixel as known in the art of additive color mixing and LED video display systems.

Typically the flexible LED pixel strings are coupled to a feeder capable of feeding both power and data to the flexible LED pixel strings. The feeder is typically controlled by a content server or light controller distributing the pixel content to the LED pixel strings. The flexible LED pixel strings can be providing in many different environments and arranged in many different shapes whereby various visual effects can be created by the flexible LED pixel strings.

Typically the flexible LED pixel string comprises a clock signal wire, a data signal wire, a reference potential wire and a power line wire. The LEDs pixels are controlled by the feeder through the string based on an internal proprietary protocol defined by the manufacture of the LEDs or the LED array and the feeder is electrically connected a content server or light controller distributing for instance through a standardized lighting control protocol such as DMX.

For instance the applicant presently provided a flexible LED pixel string named FIexDOT S1. FIexDOT S1 is a lightweight string of individually controllable, bright RGB LEDs useful in creating customized LED video solutions with maximum artistic flexibility and a minimum of effort. The FIexDOT S1 flexible LED pixel string are connected to a feeder which receives a DMX signal and controls the LED pixels based on this DMX signal.

Other companies provides similar systems for instance the company named Philips provides a range of flexible LED pixels string named iColor Flex LMX, iColor Flex MX and eW Flex SLS. These flexible LED pixel strings are also controlled by a controller which can receive DMX signals but witch in addition is capable of receiving control signals through an Ethernet connection. Similar flexible LED pixel string solutions are provide by the companies named Barco (through the system named FLX-24) and Traxon (through system named Dot XL). In general there are many companies providing system flexible LED Pixel strings.

U.S. Pat. No. 5,330,368 discloses a flat bundle of cables are each sheathed with an electrically insulative synthetic resin and arranged in a spaced relationship while extending in parallel with each other. A plurality of baseless bulbs are arranged one after another along at least one cable of the flat bundle of cables while making electrical connection to the at least one cable via lead wires. A plurality of moldable plastic material holding structures are arranged one after another in the spaced relationship along the flat bundle of cables. Each holding structure serves to firmly hold a respective baseless bulb and the flat bundle of cables so that a central axis of the bulb extends parallel with a plane of the flat bundle of cables and perpendicular to the extending direction of the cables.

U.S. Pat. No. 6,837,598 discloses a lighting device having a three-way conductor strip with three conductors extending in an axial direction and electrically connected at intervals to LED elements arranged in a row. Each LED element is in a plastic housing which surrounds the LED and the conductor strip, is light emitting and may have a lens over the LED. The housing includes two shells fixed together, and with supporting elements therein for an LED element, an adjacent axial conductor strip area and a heat activatable electrically conductive material. The three-way conductor strip comprises a continuous positive conductor, a continuous negative conductor and an interrupted central conductor that extends from LED element to LED element.

U.S. Pat. No. 6,566,824 discloses an illumination apparatus comprises a lighting segment that includes a plurality of lighting sections. Each of the sections comprises a printed circuit board having a solid state optical emitter mounted thereon. The sections are interconnected by printed circuit board connectors, which serially position the printed circuit boards with edges of adjacent printed circuit boards proximate to each other. The connectors are deformable to alter the orientation in response to an applied force. The sections are electrically connected to each other such that the solid state optical emitters are electrically connected in series. The segment has a current regulator that controls current through the solid state optical emitter.

US2006158882 discloses a LED assembly suitable to form a string provided with an LED mounted with a mounting on a base, which base is provided with electric connection wires wherein the LED mounting and electric contacts to the connection wires are protected from the surroundings by a package of hot melt material. The invention further relates to a string of interconnected LED assemblies, preferably wherein the LED assemblies are separated from each other by length of flexible contact wires.

US2010134041 discloses a device for individually driving OLED/LED elements of an OLED/LED string, comprising for each OLED/LED element of the string: a controllable shunting switch coupled with the respective OLED/LED element, switch controller means for controlling said shunting switch and having a control output port coupled to said switch, a data input port and a clock input port, level shifting means assigned to said switch controller means and adapted to bring the control input data to a level sufficient to be accepted by the switch controller means during a programming mode and to allow the control of said shunting switch. Said switch controller means of said OLED/LED elements are provided to form a serial-to-parallel converter means.

US2009147509 discloses a lighting system and method for assembling the lighting system, wherein the lighting system includes a flexible conductive strip, a control module in electrical communication with the flexible conductive strip, and a plurality of light source modules, wherein the light source modules can be coupled to the lighting system at any desired location along the length of the flexible conductive strip.

CN101424378 discloses an LED strip and an LED screen. The LED strip comprises at least two LED units, at least one positive power line, at least one negative power line and at least one signal line, wherein each LED unit comprises at least one LED and a control module thereof. Each LED unit is provided with a light collecting part which is used for reflecting out light emitted by the LED. With the technical proposal, the LED unit can be fixed on a corresponding fixation position, the connection wires between the LED units are simpler, the LED units have higher brightness and farther illumination distance and diversified LED strips with obvious decoration effect can be formed through combination.

US2008180269A describes a lighting apparatus which includes a regulator configured to receive power, LEDs of at least two different colors, and a programmable controller. The programmable controller includes software that is configured to provide a digital pulse width signal to the LEDs in response to a data signal. Also included is according to an embodiment of the present invention is a programmable controller with non-volatile memory for storing the software, which may be upgradeable.

US2010164409 discloses LED light wires comprising a plurality of dynamically addressible LED modules, each LED module comprising one or more LEDs; a microcontroller; and one or more ports, said microcontroller being configured to: check a status of at least one of said one or more ports; if the status of the port corresponds to a predetermined state: assign the LED module to which said microcontroller belongs to a first display address, and send signals to said microcontroller of a neighboring LED module, said signals assigning respective further display address to the neighboring LED module. Such LED light wires can also include a display memory which stores current display information associated with each of said LED modules in said LED light wire, and a display controller, said display controller being configured to update the current display information stored in said display memory.

US2006022214 discloses method and systems for LED modules that include an LED die integrated in an LED package with a submount that includes an electronic component for controlling the light emitted by the LED die. The electronic component integrated in the submount may include drive hardware, a network interface, memory, a processor, a switch-mode power supply, a power facility, or another type of electronic component.

One important parameter in connection with flexible LED strings is the fact that each LED pixel should emitted dentical colors when instructed there to. For instance if two LED Pixels is instructed to emit the same red color a human should not be able to distinguish the two red colors of the LED pixels. Therefor in order to ensure initial colors of each LED pixel the flexible LED pixel string have been manufactured using bined LEDs meaning that the LED manufacture have sorted the LEDs into bins where the color of the LEDs are matched within a predetermined range. However even with bined LED its difficult to provide identical colors from the different LED pixels. Another issue is the fact that typically more than one flexible LED pixel strings are used in the installations and there is thus a change that two neighboring flexible LED pixels strings would be manufactured by using LED form different bins. In fixed installations this fact is minimized by ensuring that all the flexible LED strings in the installation have been manufactured using the same LED bins. However in the touring industry the installations are often moved and changed and it is thus impossible to ensure that all the flexible LED strings are manufactured from the same bins of LEDs.

DESCRIPTION OF THE INVENTION

The object of the present invention is to solve the above described limitations related to prior art. This is achieved by flexible LED String as described in the independent claims. The dependent claims describe possible embodiments of the present invention. The advantages and benefits of the present invention are described in the detailed description of the invention.

25

Figure 4:
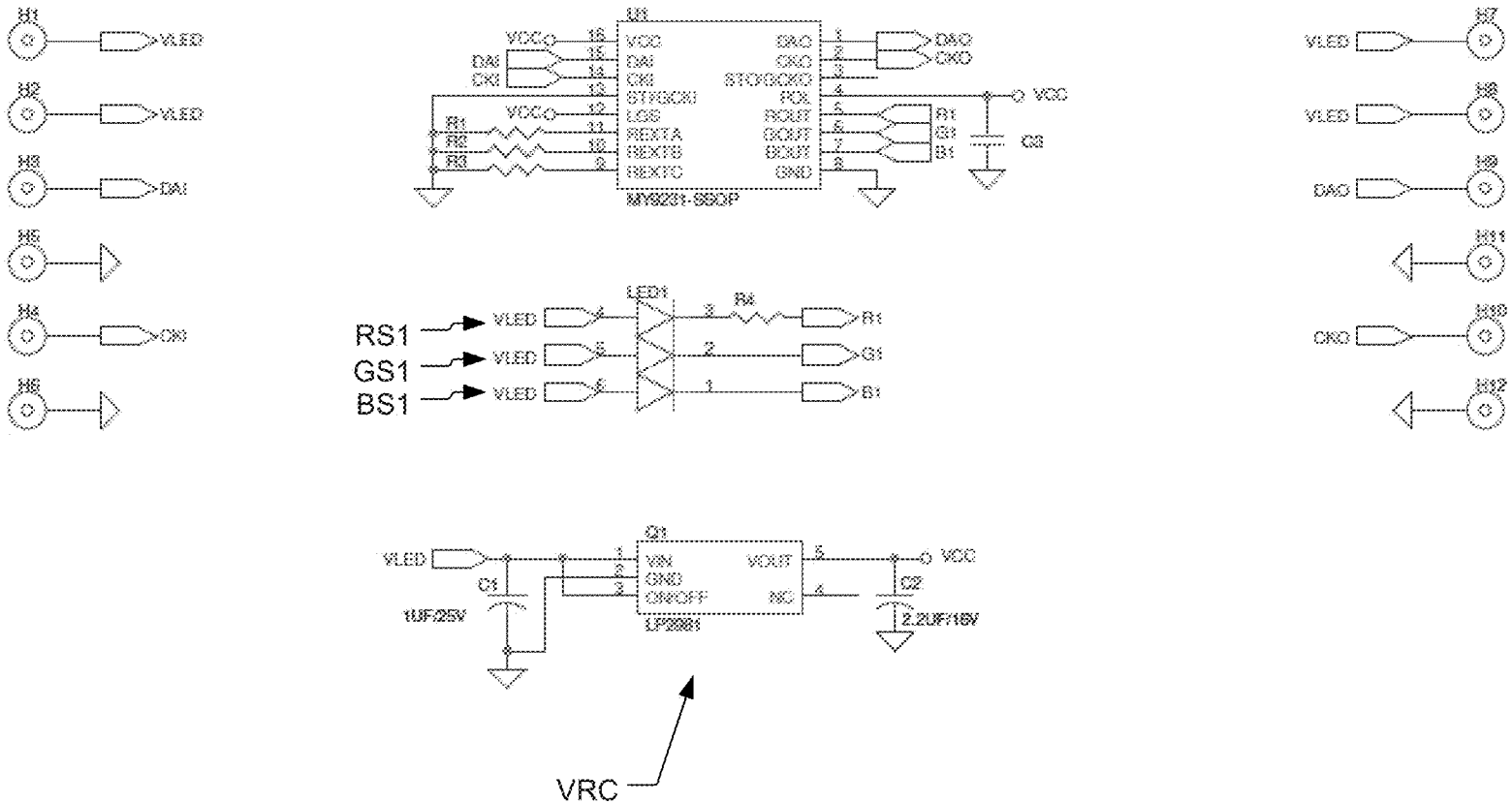
Figure 5:
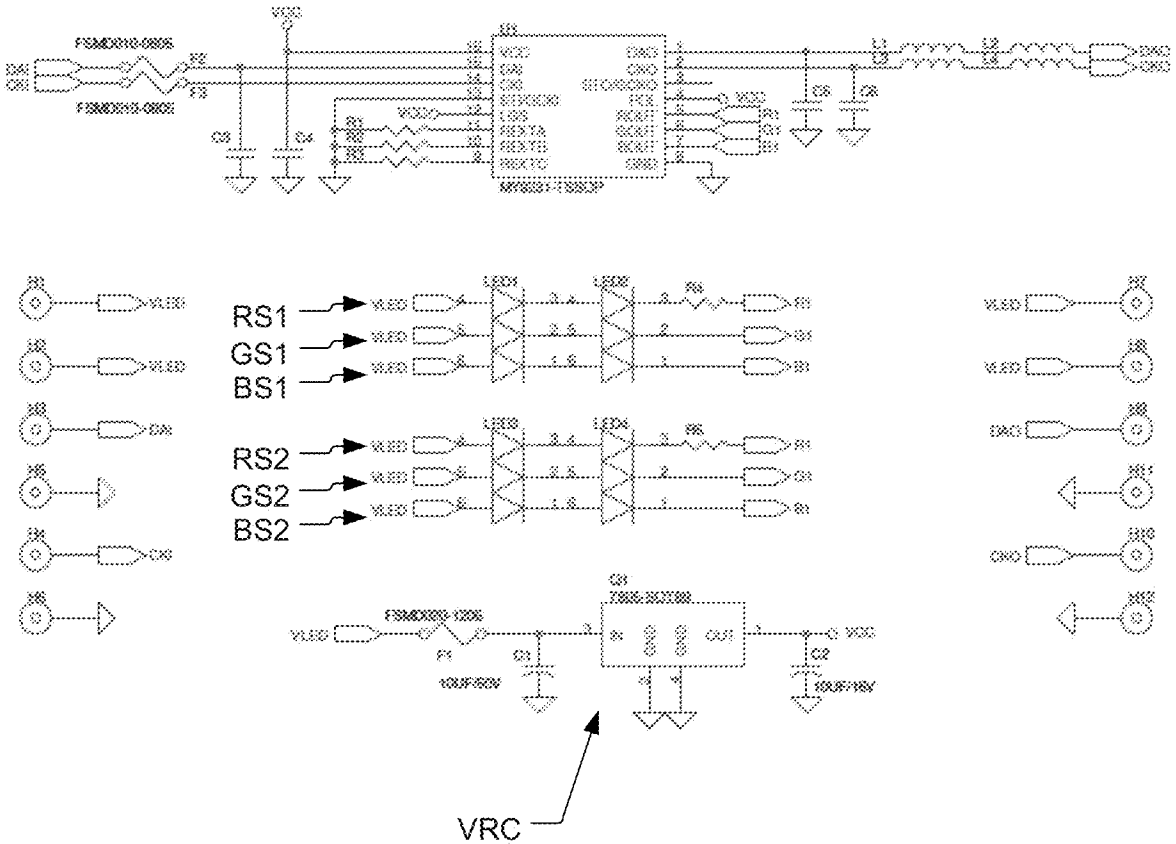
Figure 6:
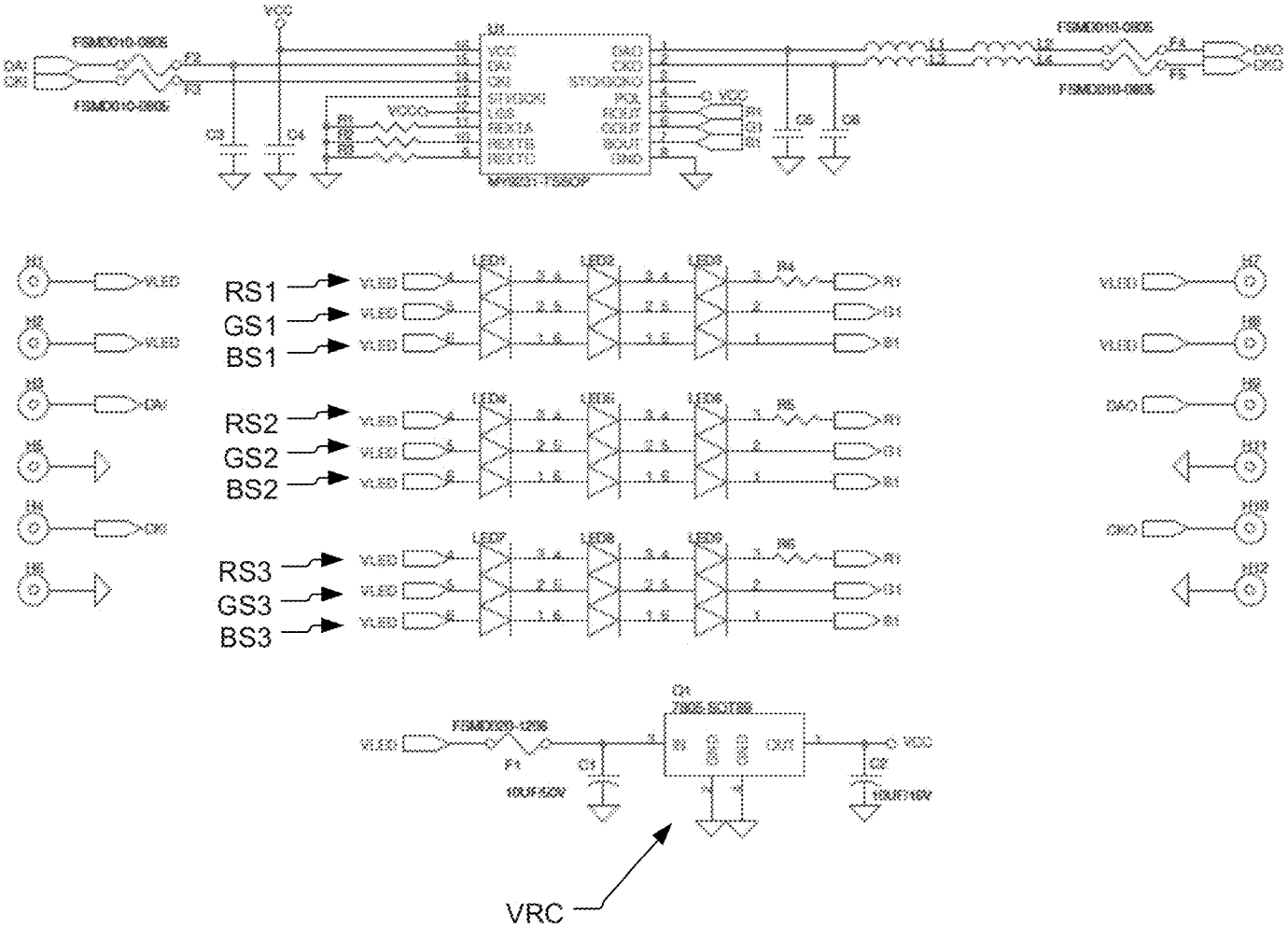

FIG. 4 illustrates a electronic diagram of a LED pixel having 1 red LED, 1 green LED and 1 blue LED;

FIG. 5 illustrates a electronic diagram of a LED pixel having 4 red LEDs, 4 green LEDs and 4 blue LEDs;

FIG. 6 illustrates a electronic diagram of a LED pixel having 9 red LEDs, 9 green LEDs and 9 blue LEDs.

DETAILED DESCRIPTION OF THE INVENTION

Figure 1:
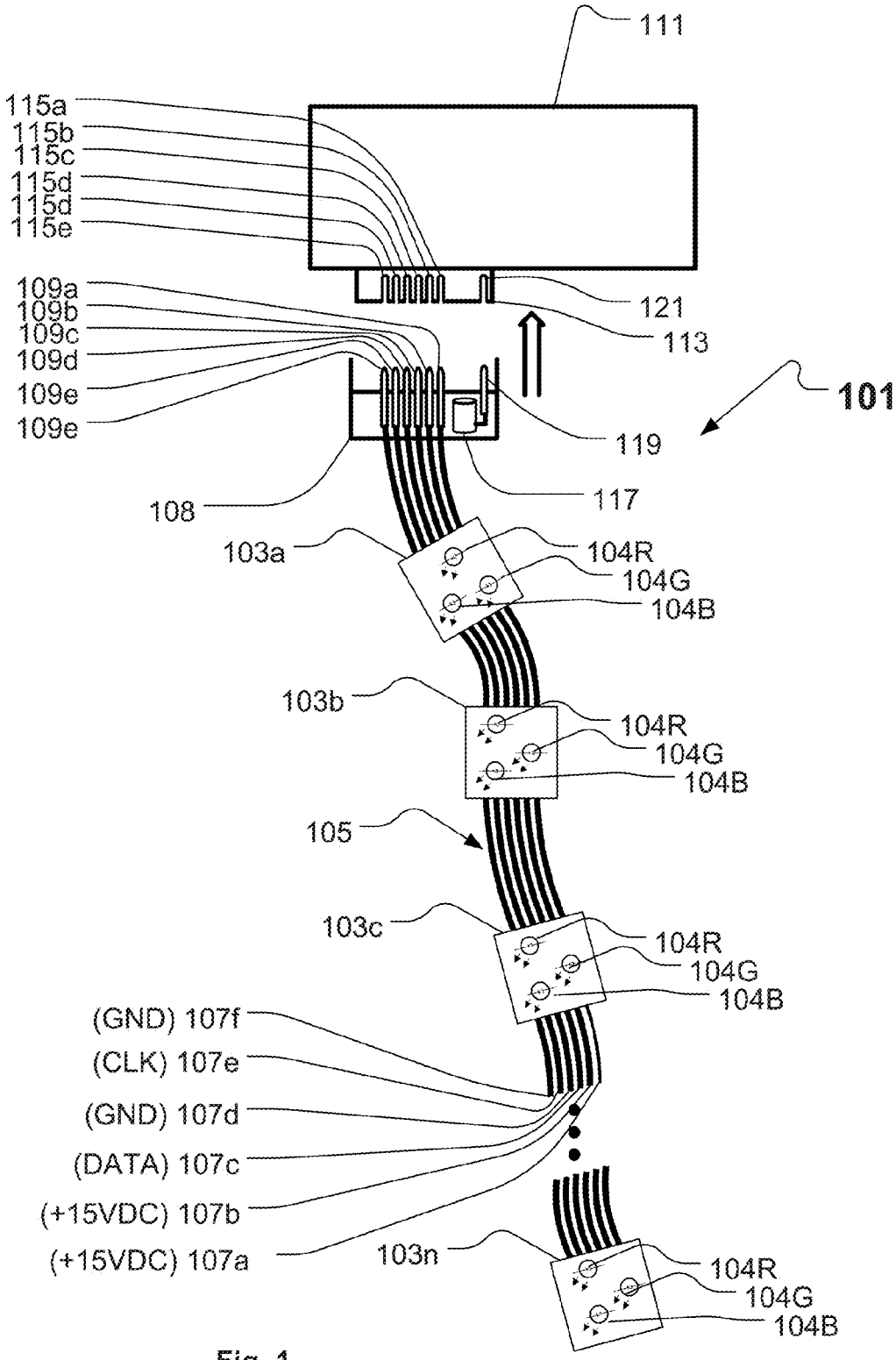
FIG. 1 illustrates a flexible LED pixel string according to the present invention.

FIG. 1 illustrates a structural diagram of a flexible LED pixel string 101 according to the present invention. The flexible LED pixel string comprises a number, n, of LED pixels 103*a*-103*n*. The LED pixels are interconnected by a flexible cable 105 comprising a multiple number of conductors 107*a*-107*f*. The multiple numbers of conductors comprises at least one power line adapted to provide power to the LED pixels and at least one data line adapted to provide data to the LED pixel. Each LED pixel 103*a*-103*n* comprises a number of LEDs and driving means (not shown) for driving the LEDs based on data received through the data line. Further it is to be understood that the power line provides power for both the LEDs and the driving means. In the illustrated embodiment each LED pixel comprises a red LED 104R, a green LED 104G and a blue LED 104B which makes it possible to generate a large number of colors based on additive color mixing as known in the art of LED display systems.

In the illustrated embodiment the flexible cable 105 comprises two power lines 107*a* and 107*b*, two ground lines 107*d* and 107*f*, a data line 107*c* and a clock line 107*e*. The two power lines are connected in parallel and reduces voltage drop along the flexible LED pixel string as more current can be lead through the two power lines. Similar applies to the ground lines 107*d* and 107*f*. The clock 107*e* line is arrange between the ground line 107*d* and 107*f* which reduces the EMC noise from the clock line and protects the clock line from external noise whereby a more stable clock signal can be feed to the LED pixels. Due to similar reasons the data line 107*c* is arranged between ground line 107*d* and power line 107*b*. Also noticeable is the fact a ground line 107*d* is situated between the clock line and data line which results in a more stable data and clock signal as the ground line 107*d* functions as a shield preventing cross talk between the data line and the clock line. In the illustrated embodiment the flexible cable is embodied as a flat cable however it is to be understood that many other kinds of multiple conductor cables can be used.

The flexible LED pixel string comprises a connector 108, and the connector 108 comprises a number of contacts 109*a*-109*f* electronically connected to the number of conductors 107*a*-107*f*. The connector is adapted to connect to a data and power feeder 111 and the data and power feeder 111 is adapted to provide power and data to the flexible LED pixel string. In the illustrated embodiment the connector 108 is a male connector where the contacts 109*a*-109*f* are adapted to fit mating female contacts 115*a*-115*f* of a female connector 113 at the data and power feeder 111. It is noticed that any type of connectors can be used and that the flexible LED pixel string connector 108 also can be a female connector while the data and power feeder connector 113 is a male connector. As will be described in connection with FIG. 3 the data and power feeder 111 is adapted to send data and power to the flexible LED string as known in the art.

Further the connector 108 at the flexible LED pixel string comprises memory means 117 connected to at least one memory contact 119. The memory contact is adapted to connect to the data and power feeder 111 through a mating contact 121 at the data and power feeder 111. This makes it possible for the data and power feeder 111 to read the memory means and thus access data stored in the memory means.

The memory means comprises calibration data related to the LEDs 104R, 104G and 1048 of the LED pixels 103*a*. This makes it possible for the data and power feeder to access the calibration data related to the LED which actually are at the flexible LED pixel string and control the flexible LED pixel string based on the calibration date. As a result the color of different flexible LED pixel strings in a display system can be eliminated as the data and power feeder can be adapted to account for eventual color differences by using the calibration data. By storing the calibration data in the connector memory 117 ensures that the data and power feeder always access the correct calibration data even when the flexible LED pixel string are changed/replaced. This is a great advantage in the touring industry as the no need to keep track of flexible LED strings manufactured using the same LED bins in order to provide an identical color presentation of different strings as the data and power feeder now can ensure identical color presentation based on the calibration data. By implementing a memory into the connector and storing the calibration data in the memory ensures that the calibration data always follows the flexible LED pixel string. Further the memory in the connector makes it possible to provide a one way communication from the data and power feeder instead of providing a two way communication where the calibration data are store in the pixel itself. This reduces the manufacturing costs and the complexity of the LED pixel. The calibration data can for instance be indicative of a color vector of each of the LED as different driving condition and the data and power feeder can be adapted to use this color vector when feeding data to the LED pixels.

In addition to the calibration data the memory can comprises specification data indicative of at least one of the following parameters:

number of LED pixels of said flexible LED pixel string;
distance between said LED pixels;
number of LEDs in each of said pixel;
serial number of said flexible LED pixel string;
types of LEDs in the pixels.

Figure 3:
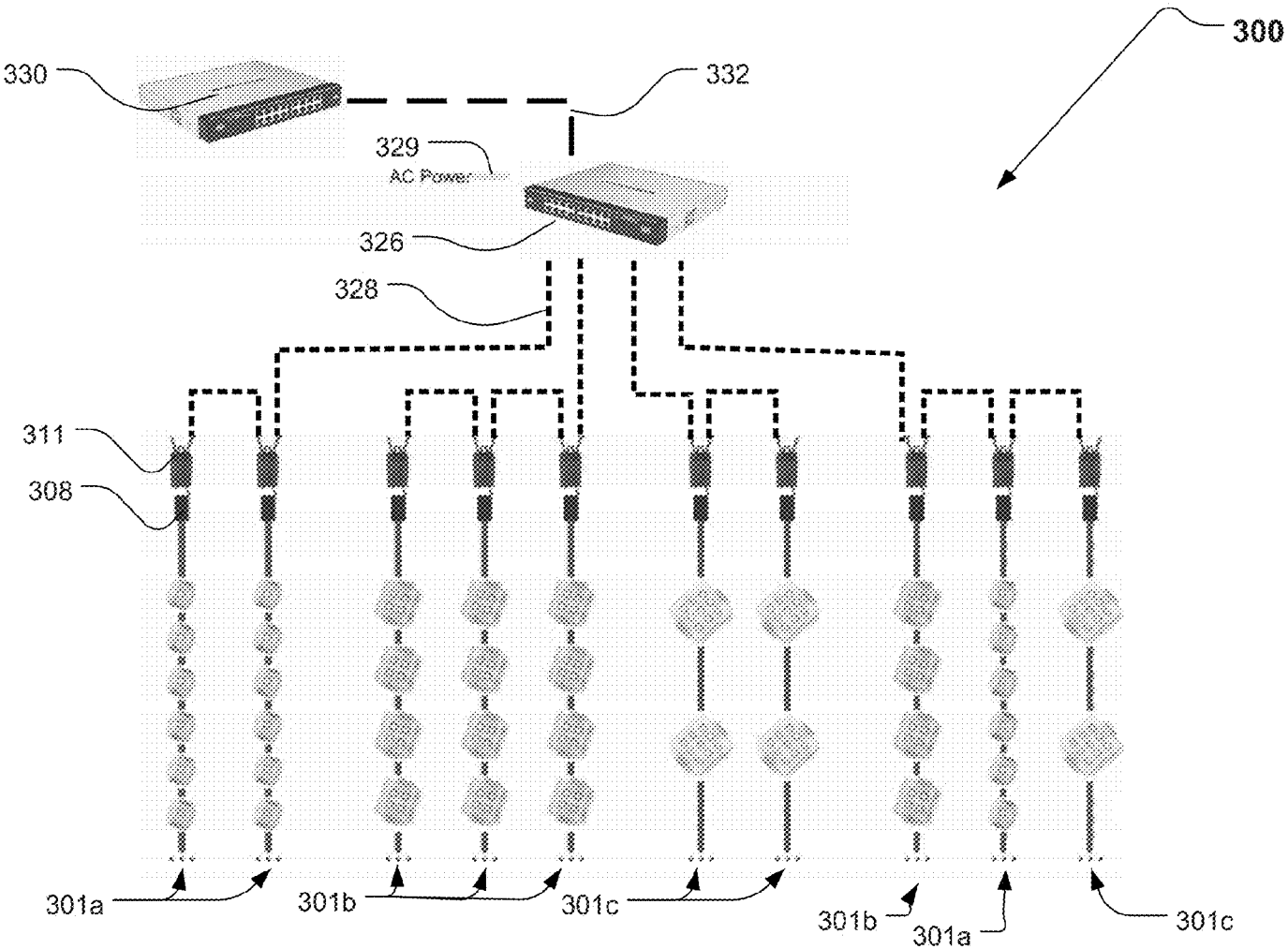
FIG. 3 illustrates a system diagram of a display system according to the present invention.

These parameters can be stored during the manufacturing process and the data and power feeder can use these data to identify which kind of flexible LED pixel string that have been connected to the data and power feeder and adjust it's way of feeding data and power to the flexible LED Pixel string. In a system as shown in FIG. 3 the data and power feeder can for instance send the number of pixels and distance between LED pixels to a main content provider, which can use this information to create a proper pixel mapping when distributing the content data.

The memory 117 can for instance be an EEPROM (e.g. a Maxim DS28EC20) which can be accessed through one wire, however it is to be understood the memory can be any kind of memory means which can be integrated in the connector and the number of memory contacts 119 can be adapted to the type of memory.

The flexible cable 105 can for instance be embodied as a 6-wire ribbon-cable (AWG20) which is soldered straight onto the PCBs of the LED pixels. Alternatively a click-on mechanism which comprises electric pins that can be pinched through the jacket of the wire and in this way attach the LED pixels to the flexible cable. Other kinds of flexible cables can also be provided.

The length of the flexible cable between the LED pixels can be provided in many different settings and even be customizable based on the customers' requests. Similar the length of the flexible cable between the first LED pixel and the connector can also be customizable.

Figure 2:
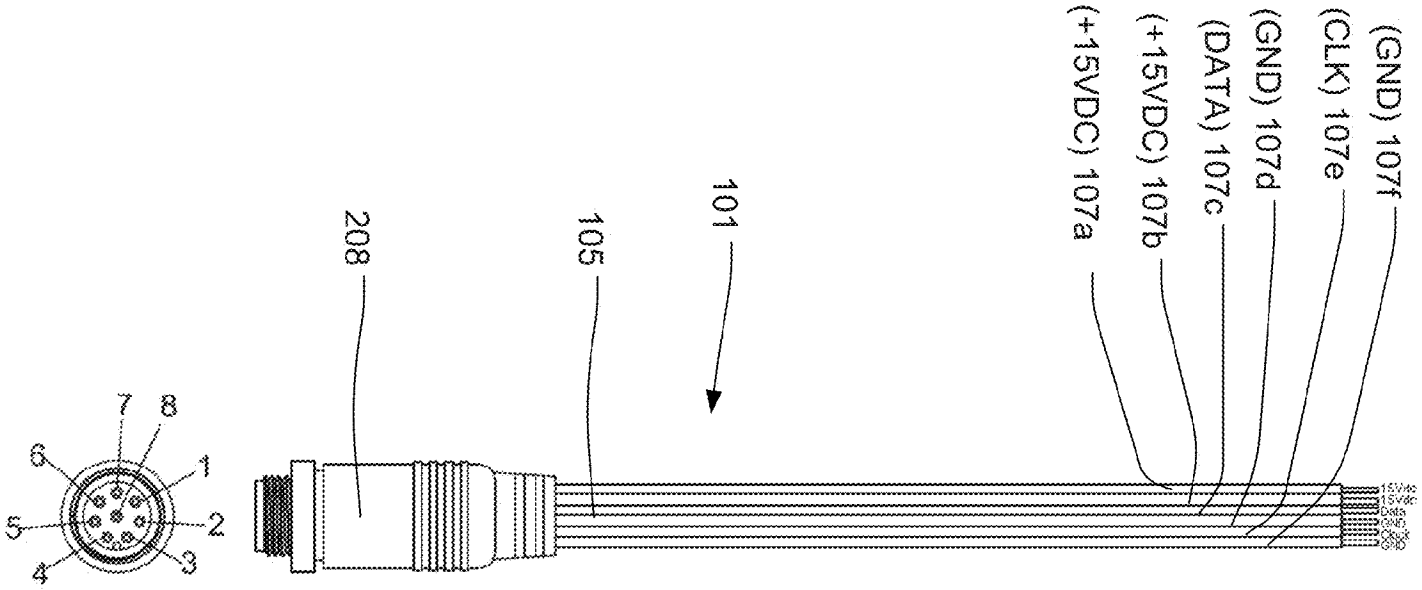
FIG. 2 illustrates an embodiment of a connector of a flexible LED pixel string according to the present invention.

FIG. 2 shows the connector 208 of a flexible LED pixel string 101. The flexible LED pixel string are substantially identical to the LED pixel string illustrated in FIG. 1 and will not be described further, except for the fact that it is noticed the LED pixels are not shown in this figure. In this embodiment the connector 208 is embodied as a standard 8 pin connector where the conductors of the flexible cable 105 is connected directly the pin 1-6 of the 8 pin connector and where pin 7 is connected to a EEPROM molded into the connector 208. In is noticed the pin 8 is not used but can for instance be used to an additional memory.

FIG. 3 illustrates a display system 300 according to one aspect of the present invention. The display system 300 comprises a number of flexible LED pixel strings 301*a*, 301*b* and 301*c*. The flexible LED pixel strings labeled 301*a* are similar to the one described in FIG. 1. The flexible LED pixels labeled 301*b* differs from the flexible LED pixel 301*a* in that each LED pixel respectively comprises 4 red LEDs, 4 green LEDs and 4 blue LEDs in order to create more light output. Similar the flexible LED pixel strings labeled 301*c* comprises 9 red LEDs, 9 green LEDs and 9 blue LEDs in order to create even more light output.

Each of the flexible LED pixel strings 301*a*, 301*b* and 301*c* are connected to a data and power feeder 311 (only the one the left labeled) through a connector 308 (only the one the left labeled) and the data and power feeders are adapted to provide power and data to the flexible LED pixel strings. As described above each connector comprises memory means connected to a number of memory contacts and the memory contacts is connected to the data and power feeder 308. The data and power feeders 308 can read the calibration data in the memory and adjust the data signals send the LED pixels based in the calibration data in order to provide a calibrated light output, whereby the color of the LED pixels in the system will be identical when they are instructed to display the same color.

The data and power feeders 308 are adapted to receive an input signal indicative of pixel data and adapted to send pixel data to the flexible LED string based on the input signal. In the illustrated embodiment the data and power feeders 308 are connected to a content provider 326 which is adapted to send the input signal to the data and power feeders 308 through a number of connection cables 328. The input signal can be any signal capable of communicating pixel data and can for instance be based on a RS485 serial protocol like DMX, RDM or the like. However special programmed protocols can also be provided. It can be seen that some of the data and power feeders are daisy chained however they can also be coupled directly to the content provide 326. The content provider 326 receives power 329 from a power supply and is also adapted to distribute power to the data and power feeders, which then can distribute the power the flexible LED pixels strings 301*a-c*. The power can be fed through a multicore cable where both the input signal and the power are fed to the data and power feeders 308. The content provider can for instance be a media server or light controller where the pixel data are stored and which are adapted to send the pixel data to the data and power feeders. However as illustrated the content provider can also be a data and power port which is connected 332 to a main content provider 330 which provides the pixel data to the content provider 326. The main content provider 330 can for instance provide the pixel data through an Ethernet connection having a large bandwidth, which cannot be feed to the data and power feeders. In this situation the content provider 326 acts a data and power port and can for instance act as a converter transforming the data signals sent from the main content provider 330 to input signals which can be interpreted by the data and power feeder. The main content provider can comprise a number of video inputs capable of receiving any video signal or format and provide the content to the pixels of the display system. The main content provider can in additional be coupled to other kinds of displays for instance high or medium resolution LED video screens, projector or the like.

For instants the main content provider may be a content provider based on the P3 protocol developed and provided by the applicant Martin Professional A/S and the content provider acting as a data and power port can be adapted to transform the P3 signals into signals readable by the flexible LED strings. The content provider can also comprise a buffer for storing received pixel data which due to differences in bandwidth of the P3 signals and the input signals to the data and power feeder from the main content provider.

The data and power feeders 311 can be adapted to transmit the data stored in the memory of connector 308 of the flexible LED pixel string to the content provider 326 which again can sent the data to the main content provider. The main content provider 330 can then use the information to create a proper pixel mapping of the LED pixels of the flexible LED pixel strings.

FIG. 4 illustrates an electrical diagram of one of the LED pixels used in the flexible LED string according to the present invention. H1-H6 illustrates the conductors of the flexible cable and corresponds to input lines, where H1 and H2 are power lines providing +15 V DC, H3 is the data line, H5 is the clock line and H4 and H6 the ground lines. Q1 are a voltage regulator circuit 550 providing the VCC to the LED driver U1, based on the VLED. U1 is the LED driver adapted to control the LEDs which comprises a Red LED connected to pin R1 a green LED connected to pin G1 and a blue LED connected to pin B1. H7-H12 are the output lines connecting the flexible cable to the next LED pixel. In illustrated embodiment Q1 is a LP2981 provided by National Semiconductor and the LED driver U1 is a MY9231 provided by Mysemi. However the person skilled in LED driving system will be able to choosing other LED drivers for instance the Macroblock MB16020, Macroblock MB16024, MySemi MY9231, MySemi MY9221.

FIG. 5 illustrates an electrical diagram of one of the LED pixels used in the flexible LED string. The electrical diagram is similar to the one illustrated in FIG. 4. However the illustrated LED pixels comprises 4 LEDs of each color and the LED driver U1 is adapted to control the LEDs which comprises a first RS1 and a second RS2 string of two red LEDs connected to pin R1, a first GS1 and a second GS2 string of two green LEDs connected to pin G1 and first BS1 and second BS2 string of two blue LEDs connected to pin B1.

FIG. 6 illustrates an electrical diagram of one of the LED pixels used in the flexible LED string. The electrical diagram is similar to the one illustrated in FIG. 4. However the illustrated LED pixels comprises 9 LEDs of each color and the LED driver U1 is adapted to control the LEDs which comprises a first RS1, a second RS2 and third RS3 string of three red LEDs connected to pin R1, a first GS1, a second GS2 and third GS3 string of three green LEDs connected to pin G1 and first BS1, second BS2 and third BS3 string of Three blue LEDs connected to pin B1.

The present invention relates also to a flexible LED pixel string comprising a number of LED pixels interconnected by a flexible cable, said LED pixels comprises a number of LEDs and said flexible cable comprises number of conductors, where said number of conductors comprises a power line for providing electrical power to said LED pixels, a data line for providing pixel data to said LED pixels, a clock line providing a clock signal to said LED pixels, a first ground line grounding said LED pixels and a second ground line grounding said LED pixels wherein said clock line is arranged between said first ground line and said second ground line. This shields the clock signal from the surroundings and thus reduces EMC caused by the clock signal but also shield the clock signal form eventual surrounding EMC which can disturbed the clock signal. In one embodiment the data line is arranged between the one of the ground lines and the power line which ensures that cross talk between the data line and clock line are prevented and further shields the data line from EMC.

The invention claimed is:

1. A flexible LED pixel string comprising a number of LED pixels interconnected by a flexible cable, said LED pixels comprising a number of LEDs and said flexible cable comprises a number of conductors, where a first one of said conductors is a power line for providing electrical power to said LED pixels, where a second one of said conductors is a data line for providing pixel data to said LED pixels, where a third one of said conductors is a clock line providing a clock signal to said LED pixels, where a fourth one of said conductors is a first ground line grounding said LED pixels, where a fifth one of said conductors is a second ground line grounding said LED pixels, wherein one of said clock line and said data line is arranged between said first ground line and said second ground line.

2. A flexible LED pixel string according to claim 1 wherein a respective other one of said clock line and said data line is arranged between said power line and said first ground line.

3. A flexible LED pixel string according to claim 1 wherein said first ground line is arranged between said power line and said clock line.

4. A flexible LED pixel string according to claim 1 wherein a sixth one of said conductors is an additional power line coupled in parallel with said power line.

5. A flexible LED pixel string according to claim 1 wherein said flexible cable is a flat ribbon-cable.

6. A flexible LED pixel string according to claim 5 wherein said flexible cable comprises a connector, said connector comprises a number of contacts electronically connected to said number of conductors, said connector being adapted to connect to a data and power feeder, and said data and power feeder is adapted to provide said pixel data, said power and said clock signal to said flexible LED pixel string.

7. A flexible LED pixel string comprising a number of LED pixels interconnected by a flexible cable, said LED pixels comprising a number of LEDs and said flexible cable comprises a number of conductors, where a first one of said conductors is a power line for providing electrical power to said LED pixels, where a second one of said conductors is a data line for providing pixel data to said LED pixels, where a third one of said conductors is a clock line providing a clock signal to said LED pixels, where a fourth one of said conductors is a first ground line grounding said LED pixels, where a fifth one of said conductors is a second ground line grounding said LED pixels, wherein one of said clock line or said data line is arranged between said first ground line and said second ground line, wherein said flexible cable comprises a connector, said connector comprises a number of contacts electronically connected to said number of conductors, said connector being adapted to connect to a data and power feeder, and said data and power feeder is adapted to provide said pixel data, said power and said clock signal to said flexible LED pixel string, wherein said connector comprises a memory connected to a number of memory contacts and where said memory contacts are adapted to connect to said data and power feeder and in that said memory comprises calibration data related to said LEDs of said LED pixels.

8. A flexible LED pixel string comprising a number of LED pixels interconnected by a flexible cable, said LED pixels comprising a number of LEDs and said flexible cable comprises a number of conductors, where a first one of said conductors is a power line for providing electrical power to said LED pixels, where a second one of said conductors is a data line for providing pixel data to said LED pixels, where a third one of said conductors is a clock line providing a clock signal to said LED pixels, where a fourth one of said conductors is a ground line grounding said LED pixels, wherein said ground line is arranged between said power line and said clock line, wherein said flexible cable comprises a connector, said connector comprises a number of contacts electrically connected to said number of conductors, said connector being adapted to connect to a data and power feeder, and said data and power feeder is adapted to provide said pixel data, said power and said clock signal to said flexible LED pixel string, wherein said connector comprises a memory connected to a number of memory contacts and where said memory contacts are adapted to connect to said data and power feeder and in that said memory comprises calibration data related to said LEDs of said LED pixels.

9. A flexible LED pixel string according to claim 8 wherein said flexible cable is a flat ribbon-cable.

10. A flexible LED pixel string comprising a number of LED pixels interconnected by a flexible cable, said LED pixels comprising a number of LEDs and said flexible cable comprises a number of conductors, where a first one of said conductors is a power line for providing electrical power to said LED pixels, where a second one of said conductors is a data line for providing pixel data to said LED pixels, where a third one of said conductors is a clock line providing a clock signal to said LED pixels, where a fourth one of said conductors is a ground line grounding said LED pixels, where a fifth one of said conductors is an additional power line coupled in parallel with said power line, wherein said flexible cable comprises a connector, said connector comprises a number of contacts electronically connected to said number of conductors, said connector being adapted to connect to a data and power feeder, and said data and power feeder is adapted to provide said pixel data, said power and said clock signal to said flexible LED pixel string, wherein said connector comprises a memory connected to a number of memory contacts and where said memory contacts are adapted to connect to said data and power feeder and in that said memory comprises calibration data related to said LEDs of said LED pixels.

11. A flexible LED pixel string according to claim 10 wherein said flexible cable is a flat ribbon-cable.

* * * * *